United States Patent [19]

Pierce et al.

[11] 4,430,237

[45] Feb. 7, 1984

[54] LIQUID DETERGENT HAVING HIGH GREASE REMOVAL ABILITY

[75] Inventors: Robert C. Pierce, Plainsboro; Frank J. Bala, Jr., South Amboy, both of N.J.

[73] Assignee: Colgate-Palmolive Co., New York, N.Y.

[21] Appl. No.: 311,824

[22] Filed: Oct. 16, 1981

[51] Int. Cl.[3] ..... C11D 1/66; C11D 1/83; C11D 17/08

[52] U.S. Cl. ..... 252/173; 252/89.1; 252/174.21; 252/551; 252/DIG. 14; 568/618; 568/680

[58] Field of Search ..... 568/618, 680; 252/DIG. 1, 174.21, 89.1, 173, 551

[56] References Cited

U.S. PATENT DOCUMENTS

| | | | |
|---|---|---|---|
| 3,666,671 | 5/1972 | Kalopissis | 252/173 |
| 3,719,636 | 3/1973 | Wojtowicz | 568/618 |
| 3,865,542 | 2/1975 | Kalopissis | 252/551 |
| 4,206,070 | 6/1980 | Jones | 252/174.21 |
| 4,217,296 | 8/1980 | Berkowitz | 568/680 |
| 4,298,764 | 11/1981 | Berkowitz | 568/618 |

*Primary Examiner*—Dennis L. Albrecht

*Attorney, Agent, or Firm*—Richard N. Miller; Murray M. Grill; Herbert S. Sylvester

[57] ABSTRACT

A detergent composition consisting essentially of a water soluble mixture of higher alkyl glyceryl ether nonionic surfactants having the structural formula $$RO-(CH_2-\overset{\overset{\displaystyle OH}{|}}{C}H-CH_2O)_nH,$$

where R is a $C_8$–$C_{16}$ alkyl radical, and n has a value of 1, 2 and 3, with an n distribution of 12–49% n=1 ethers, 24–61% n=2 ethers and 6–59% n=3 ethers.

3 Claims, No Drawings

LIQUID DETERGENT HAVING HIGH GREASE REMOVAL ABILITY

BACKGROUND OF THE INVENTION

The present invention relates to novel light duty liquid detergent compositions with superior grease removal and high resistance to foam collapse properties, particularly against nonemulsifier-containing food greases, containing a mixture of higher alkyl glyceryl and polyglyceryl ether nonionic surfactants, the n-glycidol distribution containing a maximum of 49% of n=1 with increasing amounts of n=2 and 3. Compositions with low amounts of n=1 and high amounts of n=2 and n=3 glycidol ethers are preferred, i.e., minimize the monoglycidol ether component and maximize the di- and tri-glycidol ether components.

The prior art discloses the use of nonionic surfactants such as ethoxylated alcohols, in detergent compositions, in order to improve removal of oily stains from fabrics, dishes and similar substrates. However, said alcohol ethoxylates have limited utility in light duty liquid detergents due to their low resistance to foam collapse and low removal capability for nonemulsifier-containing greases or oils, such as motor oils and greases, hydrocarbon oils and grease stains and the like.

U.S. Pat. No. 4,098,713 has attempted to solve this problem by using, as the surfactant, a monoglyceryl ether of an ethoxylated (containing 1–6 ethoxy groups) hydroxy-compound, the relative degrees of hydrophobic and hydrophilic characters in the compounds being regulated in order to provide adequate solubility. U.S. Pat. No. 4,206,070 and its British patent counterpart No. 1,560,083 disclose a binary surfactant system of monoglyceryl ether and an ethoxylated alcohol, said alcohol serving to solubilize the monoglyceryl ether which has insufficient water solubility to act as useful surfactants in aqueous solutions.

The monoglyceryl ethers of higher alkyl alcohols are known materials as disclosed in U.S. Pat. No. 2,028,654. The polyglyceryl ethers of aliphatic alcohols having the structural formula

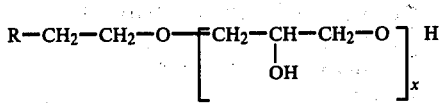

where R is a linear aliphatic hydrocarbon of 6–24 carbons and x is 4–14, useful as biodegradable wetting agents, dispersing agents and foaming agents, are disclosed in U.S. Pat. No. 3,879,475. The problem of providing sufficient water solubility to the polyglyceryl ethers defined in the aforesaid patent in order to enable them to function as useful surfactants, is overcome by the use of at least a 4/1 and preferably a 6/1 mole ratio of the reactants glycidol/alcohol.

U.S. Pat. No. 3,578,719 and No. 3,666,671 disclose nonionic surfactants having the formula

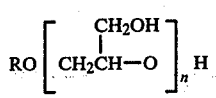

where R may be an alkyl group of 8–20 carbons and n equals 2–10; and when n is at least equal to ⅓ of the number of carbon atoms in the lipophile chain (R), the products are detergents which are soluble in water.

U.S. Pat. No. 4,086,279 discloses nonionic surfactant compositions having solubility and stability in ionic solutions, especially in basic media, prepared by reacting a 3–30 unit polyglycerol as hydrophile with a hydrophobic glycidyl ether in sufficient quantity to substitute 4–25% of the hydroxy groups of the polyglycerol.

None of the above-mentioned patents disclose a light duty liquid detergent composition containing a mixture of higher alkyl monoglyceryl and polyglyceryl ethers, as nonionic surfactants having unexpectedly superior properties of grease removal and washing performance, especially with reference to nonemulsifier-containing food greases.

U.S. Pat. No. 3,024,273 discloses anionic detergent compositions consisting essentially of a mixture of sulfonated aliphatic mono- and poly-glyceryl ether compounds containing at least 10% of the sulfonated diglyceryl ether and the balance being a mixture of the sulfonated monoglyceryl and triglyceryl ethers. This anionic sulfonate mixture of glyceryl ether has a solubility limit of about 1% neat which is too low to be of any practical use for anything but a minor ingredient. In the two step process of preparing this sulfonated mixture, a mixture of chloroglyceryl ethers is formed. However, there is no disclosure of a mixture of the nonionic alkyl glyceryl ethers of present invention.

SUMMARY OF THE INVENTION

It has now been found that a detergent composition comprising a nonionic mixture of higher alkyl glyceryl ethers, consisting essentially of a greater amount of the di- and triglyceryl ethers than the monoglyceryl ether, exhibits significantly improved grease removal and washing performance.

Accordingly, the object of the invention is to optimize grease removal, especially of the nonemulsifier-containing greases, by utilizing a nonionic detergent composition comprising a fractionated alkyl glyceryl ether mixture having an oligomer distribution of 1, 2, and 3 glycidol units with a minor amount of the 1 glycidol-containing ether and a major amount of the 2 and 3 glycidol-containing ethers.

Another object of this invention is to provide an hydro soluble nonionic detergent mixture of alkyl mono- and polyglyceryl ethers.

Still another object of this invention is to provide a method for preparing detergent compositions containing a nonionic water soluble higher alkyl glyceryl ether mixture having a particular glycidol distribution.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the novel detergent composition of this invention comprises a nonionic mixture of higher alkyl mono- and polyglyceryl ethers containing a major amount of the polyglyceryl ethers and a minor amount of the monoglyceryl ether.

Accordingly, the present invention relates to a detergent composition having high foaming and superior grease removal properties, consisting essentially of a nonionic mixture of higher alkyl glyceryl ether surfactants having the structural formula $$RO-(CH_2-\overset{\overset{\displaystyle OH}{|}}{C}H-CH_2O)_nH,$$

where R is a $C_8$–$C_{16}$ alkyl radical, and n has a value of 1 to 3, said mixture containing about 24 to 61% of such glyceryl ethers where n is 2, the balance of said mixture consisting predominantly of a mixture of such alkyl glyceryl ethers where n is 1 and 3. More specifically, about 6–9% of such glyceryl ethers where n is 3 and about 12–49% of such glyceryl ethers where n is 1 constitutes the distribution of said balance.

The alkyl glyceryl ether mixture of the present invention is a viscous liquid and/or of a jelly consistency which is soluble in an aqueous vehicle and may constitute 10% to 50%, preferably 15% to 40%, by weight of a light duty liquid detergent (LDLD) when used as the sole active ingredient (AI) therein. For example, a formulation containing 26% of the nonionic surfactant alkyl glyceryl ether mixture of the present invention as the sole surfactant is capable of maintaining excellent foaming and cleaning performance. On the other hand, when used in admixture with a water-soluble, anionic sulfonated or sulfated detergent in a light duty liquid detergent, the alkyl glyceryl ether mixture will preferably comprise from 15% to about 60% by weight of the surface active ingredients. For example, a liquid formulation containing a mixture of surfactants which includes 15% by weight of the nonionic alkyl glyceryl ether mixture of present invention has been found to provide good foaming and cleaning performance. All of the components in these light duty liquid detergents are water soluble and remain water soluble during storage. Typically, light duty liquids are diluted in use to yield concentrations of about 0.03% to 0.25% of detergent active ingredient. The particular mixture of higher alkyl glyceryl ethers of this invention is prepared by fractionating a reaction mixture of alkyl mono- and polyglyceryl ethers containing a high monoglyceryl ether content and a low polyglyceryl ether content by eluting with a series of solvents of increasing polarity, collecting each individual fraction, removing the solvent from each fraction and recovering each of the water soluble fractions. The solvent series is a butanol, ethanol, methanol and acetone sequence. The ethanol, methanol and acetone fractions contain the water soluble extracts of the alkyl mono- and polyglyceryl ethers of present invention. The uncut reaction mixture, which is water insoluble, is dissolved in chloroform prior to fractionation, in order to remove free oil and oil soluble materials.

The reaction between an alkanol and glycidol to produce glyceryl ethers, known in the prior art (U.S. Pat. No. 3,879,475), proceeds according to the following basic equation wherein R is a $C_8$–$C_{16}$ alkyl radical.

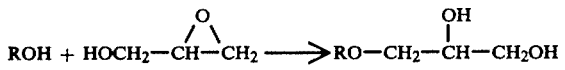

Multiple glycidol addition (1–3 moles) can be made to each ROH by increasing the amount of the glycidol reactant to be greater than the amount required to react with the alcohol to produce the mono-glycidol ether. Multiple glycidol addition to each ROH affords a control over the HLB (hydrophilic-lipophylic balance) of the nonionic product. The reaction product of the alcohol with an excess amount of glycidol is generally a mixture of oligomers containing 1 to 7 glycidol units. However, the glycidol distribution must be within certain parameters in order for this mixture to exhibit superior foaming and grease removal properties. For example, one fraction, the lauryl glyceryl ether-ethanol cut where n 1, 2, 3=12%, 24%, 54%, substantially outperforms the uncut lauryl glyceryl ether (as received from the FMC Corporation) which analyzed as n 1, 2, 3=67%, 25% and 7% in foaming as determined by the Ross-Miles foaming test (75 mm vs. 15 mm), in cleaning ability using Crisco in a Tergotometer test (23 vs. 9 planchets), and in soil removal properties (92% vs. 58%). The increase in the n=2 content and decrease in the n=1 content is demonstrated to be the cause of the superior performance. The percentage of n 1, 2 and 3 components is determined by means of gas chromotography.

The following Table 1 indicates relative performance of selected n-glycidol distributions and their neat performances at 0.04% AI concentration in the indicated tests.

The Tergotometer foam test utilizes soiled aluminum planchets (1" diameter and ⅛" high), each containing one gram Crisco soil, which are added in timed increments (every 2 minutes), to a 0.1% LDLD effective concentration containing about 40% AI in deionized or distilled water containing 150 ppm hardness as $CaCO_3$(-Ca/Mg=2/1), and 100 ppm alkalinity as $HCO_3^-$, at a temperature of 50° C., and agitated at 75 rpm for one minute. The foam level is recorded when the agitation is turned off after each addition of planchets, and the total number of planchets required to kill the foam is recorded.

The soil removal (SR) test is a static soaking test comprising a soil-containing aluminum planchet (0.5 g soil), as in the aforedefined foam performance test, which has been aged for 1½ hours and soaked for 30 seconds in a hot (50° C.) aqueous test solution of 150 ppm hardness and 100 ppm alkalinity and containing 40% AI in a LDLD of 0.1% use concentration, and is immediately transferred to an ice-water bath or washed under tap water to stop the soil removing process. The unremoved soil is solidified on the planchet which is air dried and % SR is calculated as:

TABLE 1

$$\% \text{ SR} = \frac{\text{Amount of Soil Removed}}{\text{Original Amount of Soil}} \times 100\%$$

| Surfactant-glycidol distribution | n (%) | | | % Grease removal (SR) | | Terge/ Crisco |
|---|---|---|---|---|---|---|
| Lauryl glyceryl ether | 1 | 2 | 3 | Crisco | Keen[1] | (planchets) |
| chloroform fraction | 95, | 2, | 0 | 22 | 0 | 3 |
| uncut parent material | 67, | 25, | 7 | 48 | 0 | 9 |
| butanol fraction | 49, | 45, | 6 | 44 | 0 | 15 |
| methanol fraction | 17, | 61, | 22 | 81 | 0 | 18 |
| ethanol fraction | 12, | 24, | 54 | 94 | 34 | 23 |
| $C_{14-15}$ alcohol ethoxylated with 11 ethoxy groups (average) | | | | 85 | 0 | 8 |

[1]nonemulsifier-containing grease

As shown above, the fraction where n 1, 2, 3=12%, 24%, 54% isolated from an uncut lauryl glyceryl ether (LGE) sample substantially outperforms the original broad distribution sample in laboratory light duty liquid detergent foam and cleaning tests, and surpasses the performance of alcohol ethoxylates in heavy duty detergent oil soil removal evaluations.

These new alkyl glyceryl ether nonionic detergent mixtures may be used per se or in combination with other surface active agents, which may be of the anionic and/or nonionic type. Linear alkyl benzene sulfonates having alkyl chains of 8 to 16 carbon atoms, secondary $C_{12}$-$C_{20}$ alkene sulfonates, and $C_8$–$C_{18}$ alkyl ether ethoxy sulfates containing an average of about 1–10 moles ethylene oxide, are suitable anionic surfactants. Alcohol ethoxylates are examples of suitable nonionic surface active agents. These additional surface active agents may be utilized with the novel alkyl glyceryl ether mixture in ratios of 1:10 and up to 10:1. Similarly, pure n=2 or n=3 oligomer containing surfactants (higher alkyl diglycidol or triglycidol ether) may be used in lieu of the mixture having an n-glycidol distribution of 1 to 3, as defined herein. However, fractionation is not specific enough to enable separation of pure n=2 or n=3 from the mixture.

In addition to the water soluble nonionic alkyl glyceryl ether mixture constituent of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; preservatives such as formaldehyde or hydrogen peroxide; pearlescing agents and opacifiers; pH modifiers; hydrotropes such as ammonium or sodium xylene sulfonate, ethyl alcohol; citric acid; etc. The proportion of such adjuvant materials, in total, will normally not exceed 15% of the detergent composition. The percentages of most of such individual components will be a maximum of 5% and preferably less than 5%.

The present light duty liquid detergents such as dishwashing liquids are readily made by simple mixing methods from readily available components which, on storage, do not adversely affect the entire composition.

The viscosities are adjustable by changing the total percentage of active ingredients. In all such cases the product made will be pourable from a relatively narrow mouth bottle (1.5 cm diameter) or opening, and the viscosity of the detergent formulation will not be so low as to be like water. The viscosity of the detergent should be at least 200 cps at room temperature, and up to about 1,000 centipoises, as measured by a Brookfield RVF viscometer using a number 2 spindle rotating at 20 RPM. Its viscosity may approximate those of commercially acceptable detergents now on the market. The detergent viscosity and the detergent itself remain stable on storage for lengthy periods of time, without color changes or settling out of any insoluble materials. The pH of this formulation is preferably neutral, about 6 to 8.

These products have unexpectedly desirable properties. For example, the foam quality and cleansing performance is superior to standard light duty liquid detergents and a smaller active ingredient content may be used.

DETAILED DESCRIPTION OF THE INVENTION

The following examples are merely illustrative of the invention and are not to be construed as limiting thereof.

The following examples specifically disclose the method of fractionation utilized in present invention.

EXAMPLE 1

An aliquot of the uncut lauryl glyceryl ether (LGE) mixture obtained from the FMC Corporation which is described in Table I was fractionated by first diluting 16 gms with 250 ml chloroform and passing it through a silica gel (40–140 mesh) column. FDC Red No. 3 was added to the column to indicate when the elute band is leaving the column. After the addition of the chloroform to the column to remove any free oil or oil soluble material, the LGE was eluted with the following solvents in the following order: Butanol, Ethanol, Methanol and Acetone.

All solvent cuts were retained and the solvents were distilled off to yield the fractions described in Table I, and the extracted material was diluted as described below prior to evaluation.

Chloroform extract: 6.9 g diluted to 100 ml with a 50/50 water/ethanol solution

Butanol extract: 7.1 g diluted to 100 ml with 50/50 water/ethanol solution

Ethanol extract: 1.0 g diluted to 100 ml with distilled water

Methanol extract: 0.6 g diluted to 100 ml with distilled water

Acetone extract: 0.1 g diluted to 100 ml with distilled water

The chloroform and butanol cuts (extracts) are substantially water insoluble because they contain a large amount of the alkyl monoglyceryl ether which is a water insoluble solid or waxy material, whereas the ethanol, methanol and acetone cuts which contain lesser amounts of the monoglyceryl ether and larger amounts of the polyglyceryl ethers are water soluble.

EXAMPLE 2

To provide additional material for performance testing, two aliquots of the uncut LGE from FMC Corporation described in Table I were run through a column of 40–140 mesh silica gel. 13.6 and 14.7 g LGE respectively were dissolved in chloroform and a sample amount of FD & C Yellow No. 3 was added as an indicator of band fractionation. The column was primed by passing chloroform through the column and then adding the LGE/chloroform. More chloroform was added to the column to remove free oil and oil soluble material. This fraction was discarded. Then the LGE is fractionated by adding the following order of solvents. 1-Butanol, 3A Ethanol (5.0% $H_2O$), Methanol, Acetone. The acetone removes any remaining material on the column after the methanol elution. The solvent fractions of both samples were combined and the solvent was distilled off in a distillation apparatus. The amount of recovered material from the two aliquots (13.6 g+14.7 g=28.3 g) is shown below and these fractions exhibit the oligomer distribution reported in Table I for the corresponding fractions.

| | Gross | Tare | Net Weight Material |
|---|---|---|---|
| 1-Butanol | 390.70 g | 372.60 g | 18.10 g |
| 3A Ethanol | 374.10 g | 372.50 g | 1.60 g |
| Methanol | 373.85 g | 373.20 g | 0.65 g |
| Acetone | 372.50 g | 372.45 g | 0.05 g |

The recovered material is dissolved in distilled water and removed from the distillation apparatus.

EXAMPLE 3

A 34 gm aliquot of uncut LGE described in Table 1 was fractionated in accordance with the procedure of Example 2 to provide butanol, ethanol and methanol fractions having the distribution set forth in Table 1 for further testing. These fractions were tested for oily soil removal performance in particulate heavy duty detergent compositions of the phosphate and non-phosphate type. While both types of composition contained 20% by weight of the alkyl glyceryl ether mixture, the balance of the phosphate formulation comprised by weight 60% of pentasodium tripolyphosphate, 10% of sodium silicate (1 $Na_2O$:2.35 $SiO_2$) and 10% of brightener, color and moisture; and the balance of the non-phosphate formulation comprised 25% sodium carbonate, 25% sodium bicarbonate, 20% sodium silicate and 10% of brightener, color and moisture. In the test, swatches (3"×4") of dacron-cotton (65/35) permanent press, dacron and nylon fabric soiled with an oily soil are washed in 0.04% concentration of detergent composition and the amount of soil removed is the sum of the differences in reflectance between the soiled swatch and the cleaned swatch for all of the soiled swatches. The performance results indicate that the ethanol fraction and the methanol fraction of the alkyl glyceryl ether were equivalent to a $C_{12}$–$C_{13}$ alkanol ethoxylate (6.5 EO) in the phosphate formulation, but poorer than said alkanol ethoxylate in the non-phosphate formulation. As the standard alkanol ethoxylate (6.5 EO) is a good performing nonionic detergent in this test, such results show that the improved alkyl glyceryl ether nonionic surfactants are effective for cleaning oil-soiled fabrics.

A comparison of the foam heights of the uncut LGE mixture and the ethanol fraction prepared in the laboratory is shown in Table 3 wherein the test material was diluted to a volume of 200 ml of 150 ppm hardness water in a 500 ml graduated mixing cylinder at 70° F. and rotated for 15 seconds and the foam height measured.

TABLE 3

| | Foam Heights | |
|---|---|---|
| Concentration (%) | Uncut LGE | Ethanol cut |
| 0.005 | 15 ml | 85 ml |
| 0.010 | 30 ml | 115 ml |
| 0.015 | 35 ml | 130 ml |
| 0.020 | 45 ml | 160 ml |
| 0.025 | 45 ml | 175 ml |
| 0.030 | 45 ml | 200 ml |
| 0.040 | 50 ml | 215 ml |
| 0.050 | 55 ml | 225 ml |
| 0.075 | 55 ml | 250 ml |
| 0.100 | 70 ml | 270 ml |
| Average | 44.5 | 182.5 |

These comparative results clearly show the unusually high foam obtained with the particular blend of alkyl mono-, di- and triglyceryl ethers defined in present invention.

EXAMPLES 4–7

Dishwashing Formulations

| | Examples (%) | | | |
|---|---|---|---|---|
| Ingredients | 4 | 5 | 6 | 7 |
| Ethanol cut of LGE* | 17 | 0 | 0 | 26 |
| Methanol cut LGE** | 0 | 17 | 26 | 0 |
| Lauryl benzene sulfonate | 13 | 13 | 0 | 0 |
| Lauryl methyl myristic amide | 4 | 4 | 0 | 0 |
| Deionized Water | 66 | 66 | 74 | 74 |

*Oligomer distribution - n 1 = 12%, n 2 = 24%, n 3 = 54%
**Oligomer distribution - n 1 = 17% n 2 = 61%, n 3 = 22%

The methanol or ethanol cut LGE is dissolved in the water with agitation at room temperature or at slightly elevated temperatures (below 100° C.). The other ingredients, i.e., the benzene sulfonate and the amide are added to the aqueous solution with agitation. The resultant products are thickened solutions with no sign of particulate suspension or precipitation.

Variations in the above formulations may be made. For example other surfactants such as ethoxylates, alcohol ethoxy sulfates, secondary alkene $C_{14}$–$C_{15}$ sulfonates, and other higher alkyl benzene sulfonates may be substituted for the lauryl benzene sulfonate surfactant.

Likewise, other glyceryl ether mixtures may be substituted for the lauryl glyceryl ether mixture such as decyl glyceryl ether mixture, tetradecyl glyceryl ether mixture and the like, provided the glycidol distribution corresponds to the ethanol, methanol and acetone fractions of the lauryl glyceryl ether mixture. More specifically, the glycidol content is adjusted so that the hydrophilic-lipophilic balance (HLB) is the same as that of the respective lauryl glyceryl ether (dodecyl) fractions. HLB is the balance between the hydrocarbon (R) moiety and the glycidol moiety which is about 9 to 12.

In addition, the amount of the water soluble mixture of alkyl glyceryl ethers may vary within the range of about 10% to 50% by weight as the sole detergent in an LDLD composition. Likewise, in admixture with other water-soluble, synthetic organic detergents, the amount of the other detergent, e.g., alkyl benzene sulfonate surfactant or equivalent surfactant may vary, provided it is within the ratio of 1:10 of additional surfactant:-glyceryl ether mixture and up to 10:1 thereof.

The invention has been described with respect to various examples and embodiments but is not to be limited to these because it is evident that one of skill in the art with the present application before him will be able to utilize substituted and equivalents without departing from the spirit of the invention.

We claim:

1. A liquid detergent composition consisting essentially of about 15% to 40% by weight of a nonionic mixture of higher alkyl glyceryl ether surfactants having the structural formula:

$$RO-(CH_2-\overset{\overset{\displaystyle OH}{|}}{CH}-CH_2O)_nH,$$

where R is an alkyl radical containing 8 to 16 carbons, and n has a value of 1 to 3, said mixture containing 12% to 40% by weight of glyceryl ethers where n is 1, 24% to 61% by weight of glyceryl ethers where n is 2 and 6% to 50% by weight of glyceryl ethers where n is 3, and an additional anionic or nonionic surface active agent in an aqueous vehicle, the weight ratio of said additional surface active agent to said glyceryl ether mixture being in the range of 10:1 to 1:10.

2. A water-soluble detergent composition consisting essentially of, by weight, a nonionic mixture of higher alkyl glyceryl ether surfactants having the structural formula:

$$RO-(CH_2-\overset{\overset{\displaystyle OH}{|}}{C}H-CH_2O)_nH,$$

where R is an alkyl radical containing 8 to 16 carbons, and n has a value of 1 to 3, said mixture containing about 12% glyceryl ethers where n is 1, about 24% of glyceryl ethers where n is 2 and about 54% of glyceryl ethers where n is 3.

3. A liquid detergent composition consisting essentially of about 15 to 40% by weight of the water soluble detergent composition of claim 2 in an aqueous vehicle.

* * * * *